United States Patent [19]

Sadler et al.

[11] 3,931,027

[45] Jan. 6, 1976

[54] CELLULOSE MATERIAL TREATED WITH A THERMOSETTING RESIN AND HAVING IMPROVED PHYSICAL PROPERTIES AT ELEVATED TEMPERATURES

[75] Inventors: Fred S. Sadler, Racine; John Lapp, Franklin, both of Wis.

[73] Assignee: McGraw-Edison Company, Milwaukee, Wis.

[22] Filed: June 25, 1973

[21] Appl. No.: 372,975

[52] U.S. Cl. ..... 252/63.7; 252/63.2; 8/196; 8/120; 8/194

[51] Int. Cl.[2] ..... H01B 3/18; H01B 3/00; D06M 13/34; D06M 13/00

[58] Field of Search ..... 8/194, 196, 181, 120, 129, 8/131; 252/63.7, 63.2, 63, 64

[56] References Cited

UNITED STATES PATENTS

| | | | |
|---|---|---|---|
| 2,722,561 | 11/1955 | McCulloch | 252/63.7 |
| 2,912,382 | 11/1959 | Liao | 252/63.7 |
| 3,102,159 | 8/1963 | Ford | 252/63.7 |
| 3,211,516 | 10/1965 | Sadler | 252/63.7 |
| 3,429,819 | 2/1969 | Tierney | 252/63.7 |

OTHER PUBLICATIONS

Encyclopedia of Polymer Science and Technology Vol. 6, p. 235.

Encyclopedia of Chemical Technology Kirk–Othmer, 2nd Ed., Vol. 6, p. 569.

Encyclopedia of Chemical Technology Kirk–Othmer, 1st Ed., Vol. 4, pp. 673–675.

*Primary Examiner*—Leland A. Sebastian
*Assistant Examiner*—Donald P. Walsh
*Attorney, Agent, or Firm*—Andrus, Sceales, Starke & Sawall

[57] ABSTRACT

Cellulose material having improved resistance to thermal deterioration and having particular application as insulation material for electrical apparatus. The cellulose material is treated with an aqueous dispersion of a liquid, uncured, crosslinkable thermosetting resin, such as an epoxy resin, and a water soluble, nitrogen-containing compound. During curing of the resin, the cellulose molecules are believed to enter into the crosslinking reaction to provide a treated cellulosic product capable of withstanding the deteriorating action of heat over extended periods of time. A protein material, such as casein or isolated soy protein, can be added to the treating liquid and the protein not only contributes additional nitrogen groups to the treating media to further increase the thermal stability of the cellulose, but also acts as a film former. The thermal stability of the cellulose material can be further improved by the addition of an organic amine, such as melamine, to the treating liquid.

17 Claims, 2 Drawing Figures

CELLULOSE MATERIAL TREATED WITH A THERMOSETTING RESIN AND HAVING IMPROVED PHYSICAL PROPERTIES AT ELEVATED TEMPERATURES

BACKGROUND OF THE INVENTION

Cellulose fiber materials tend to deteriorate when subjected to elevated temperatures for extended periods of time, resulting in a progressive reduction in their strength until eventual fracture occurs. Cellulose insulation materials are used extensively in electrical apparatus and during use are subjected to elevated temperatures. In electrical apparatus, such as transformers for example, the rate of deterioration is further increased because the cellulose insulation is in contact with, or immersed, in a liquid dielectric, such as transformer oils. Elevated temperatures cause the liquid dielectrics to decompose and the resultant products of decomposition, in turn, attack the cellulose insulation. For this reason cellulose insulation materials in contact with liquid dielectrics generally deteriorate at a far greater rate than cellulosic material not in contact with such liquids.

The problem of deterioration of cellulose fiber material at elevated temperatures is also encountered when using cellulose fiber cord reinforcing in rubber articles, such as pneumatic tires, steam hoses, conveyor belts, and the like. In this situation, the cellulose fiber reinforcement which is subjected to elevated temperatures either from external heat or from heat generated internally by reason of repeated flexing, as in the case of pneumatic tires, tends to deteriorate, resulting in a progressive reduction in the strength of the cellulose fiber reinforcement.

Deterioration of cellulose fiber material at elevated temperatures is also encountered in calendar rolls used in the papermaking industry. Calendar rolls are usually formed of a series of laminated, annular, or layers of paper and during use, the calendar roll is subjected to a hot air environment along with mechanical stressing which can cause rapid deterioration of the cellulosic material.

SUMMARY OF THE INVENTION

The invention is directed to treated cellulose materials having improved thermal stability which enables the cellulose material to withstand the deteriorating action of heat over extended periods of time.

In accordance with the invention, the cellulose fiber material is treated with an aqueous treating medium containing a dispersion of a liquid, uncured crosslinkable thermosetting resin and an amine curing agent. Following evaporation of the aqueous carrier or vehicle, the resin is cured or crosslinked and it is believed that the hydroxyl radicals in the cellulose material enter into the crosslinking reaction to provide a cured product having improved thermal stability without sacrifice of the initial physical properties of the untreated paper.

A protein material, such as casein or soy protein, can be included in the liquid treating medium. The protein material not only includes amine groups which aid in improving the thermal stability of the treated cellulose material, but also acts as a film-former and a dispersing agent to maintain the resin in suspension in the aqueous treating medium. It is preferred when using a protein material to also include an organic amine solvent for the protein which is miscible with water to thereby make the protein material soluble in the aqueous solution.

To further increase the thermal stability of the treated cellulose, a nitrogen containing material such as melamine, can be added to the treating liquid.

When the treated cellulose material is to be us in fabrication of a calendar roll, added flexibility may be provided by incorporating a plasticizer, such as glycerine or propylene glycol, in the treating liquid.

The resulting treated cellulose has improved thermal stability when exposed to liquid dielectrics, such as transformer oils, or when exposed to hot air environments.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
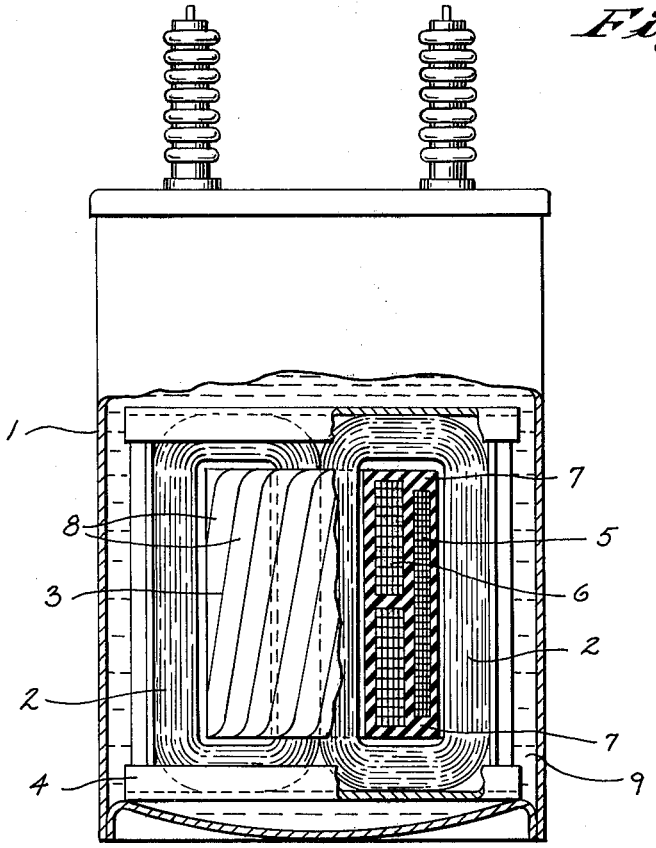
FIG. 1 is a sectional view of a transformer embodying cellulose insulation which has been treated in accordance with the invention.

The transformer as shown in FIG. 1 is encased within a tank 1 and consists of a magnetic core 2 and a coil 3, both of which are supported in spaced relation from the bottom of the tank 1 by channel support members 4, or the like. The coil 3 comprises a high voltage winding 5 and a low voltage winding 6 which are insulated from one another by the treated cellulose insulation 7 of the invention. A treated cellulose wrapping 8 may also be applied to the exterior of the coil 3.

A standard dielectric liquid 9, comprising oil, chlorinated diphenyl, or the like, is located within the tank 1 to cover the core 2 and the coil 3 and serves to insulate the core and coil as well as dissipate the heat generated during operation.

The cellulose fiber material to be used as the layers 7 and 8 can be Kraft paper, cotton, linen or other cellulosic materials commonly used as insulation in electrical apparatus.

In accordance with the invention, the cellulose material is treated with an aqueous dispersion of a liquid, uncured, thermosetting resin and an amine curing or crosslinking agent. The resin can take the form of an epoxy resin, either glycidyl ethers or esters, with the preferred epoxy resin being the diglycidyl ether of bisphenol-A and epichlorohydrin. In addition, dispersible, aromatic diclycidyl esters and cycloaliphatic diglycidyl esters can also be utilized as the epoxy resin component. The thermosetting resin can also be a polyester resin which is a condensation polymer resulting from the reaction of dicarboxylic acids and polyhydric alcohols, as for example, when maleic acid or anhydride is reacted with glycerol, ethylene glycol, diethylene glycol, sorbitol, mannitol, polyethylene glycol and the like. To aid in dispersing the resin in the aqueous medium, the resin may contain a conventional dispersing agent.

The thermosetting resin is utilized in an amount such that the dry cellulose paper will contain from 5 to 65% by weight of the resin, based on 100% solids.

In addition to the water dispersible thermosetting resin, the liquid treating medium contains an organic amine in an amount, based on 100% solids, of 0.1% to 10% by weight of the cellulose material. The amine is preferably water soluble and can be an aliphatic or cyclic amine, and can be a mono-amine, a diamine or a tertiary amine. The amine can take the form of dicyandiamide, triethyl amine, diethyl amine, disiopropyl amine, triethanol amine, diethanol amine, monoethanol amine, piperidine, N-amino-propyl morpholine, methyl diethanol amine, trimethylene diamine, morpholine, dimethylformamide, n-amino ethyl piperazine, and the like.

When using an epoxy resin system, the amine acts as a crosslinking or curing agent and crosslinks with the epoxy resin. It is believed that the hydroxyl radicals on the cellulose material also enter in to the crosslinking reaction. The amount of the amine crosslinking agent to be used is not critical, but it should be present in at least a stoichemiometric amount with respect to the epoxy resin.

When a polyester resin system is utilized the amine also aids in accelerating the cure in the polyester system.

A protein material, such as casein, isolated soy protein, or collagen type protein can be incorporated in the treating liquid in an amount of 0.1% to 10% by weight of the cellulose material, based on 100% solids. The protein material includes amine groups which aid in the crosslinking reaction and also contribute thermal stability to the treated cellulose. As a further advantage, the protein material acts as a film-former and serves to retain the resin in suspension or dispersion in the aqueous liquid. To solubilize the protein material in the aqueous solution, a small amount of a water soluble, highly basic amine, such as morpholine or diglycolamine, can be added to the solution. The basic amine is generally used in an amount of 0.1 to 5.0% of the cellulose fiber material to be subsequently treated. The protein material is soluble in the highly basic amine, which in turn is miscible with water, thereby enabling the protein material to be solubilized in the aqueous treating medium.

Additional heat stability can be provided for the treated cellulose material by incorporating an organic nitrogen-containing compound in the treating liquid in an amount of 0.2% to 20% by weight of the cellulose material based on 100% solids. The nitrogen-containing compound preferably has a reactive $NH_2$ group and serves the dual function of not only increasing the heat stability of the cellulose but also can act as a curing agent for the thermosetting resin system. Examples of compounds which can be used are melamine, urea, dicyandiamide, diglycolamine, polyoxypropylenamine, phenylene diamine, p-amino phenol, and the like.

The cellulose material can be impregnated with the aqueous treating medium in any suitable manner, such as by immersing the cellulose fibers in the treating liquid for a time sufficient to fully impregnate the fibers, or by spraying, brushing, dipping, size pressing, or the like. It is important that all of the individual fibers or filaments of the cellulose material be impregnated with the treating liquid, so that each individual cellulose fiber is able to react with the active ingredients. Impregnation differs from surface coatings in which only the outer surface of the fibrous mass is coated with the active ingredients and the individual fibers in the interior of the mass are generally uncoated.

In treating the cellulose fibers, the treating liquid may be at room temperature or at a higher temperature up to its boiling point. The time of contact between the cellulose fiber material and the treating liquid should be sufficient to permit substantial penetreation of the fibers. Normally a time in the range of 1 to 10 minutes is adequate for this purpose, although longer times may be employed without adverse effect.

The concentration of active ingredients used in the treating liquid may vary considerably both with respect to the total ingredients and the individual additives, although it is somewhat more difficult to achieve the desired pick-up of additives from a very dilute solution as compared to a more concentrated one. Treating liquid containing as little as 1% solids can be used. Typically, however, the treating liquid will have 5% to 30% by weight of active ingredients.

Additional impregnation of the individual cellulose fibers by the thermosetting resin can be achieved by incorporating a water-soluble solvent for the resin in the treating solution. Nitrogen containing compounds, such as dimethyl formamide or morpholine, can be utilized for this function. These materials are used in an amount of 0.01% to 5% by weight of the cellulose material and act to solubilize the resin in the aqueous solution, and due to the nitrogen-containing groups, act as co-curing agents for an epoxy resin system and also contribute additional heat stability to the treated cellulose.

After treatment with the aqueous treating medium, the cellulose material is dried to evaporate the water. While drying can be carried out at room temperature, it is preferred to heat the cellulose material to a temperature in the range of 175°F to 325°F to accelerate the evaporation of the water. The crosslinking reaction involving the thermosetting resin will occur at room temperature, but is preferably accelerated by heating the cellulose material to a temperature of 225°F to 325°F for a period of 5 to 60 minutes. In practice a single heating cycle may be utilized to both evaporate the water and cure the resin system.

After curing or crosslinking of the resin system, the cellulose should contain from 0.3 to 10% nitrogen by weight of the cellulosic fibers, and this amount of nitrogen is contributed by the amine curing or crosslinking agents, the protein material, the solubilizer for the protein material and/or resin, and the organic amine heat stabilizer, if employed.

Figure 2:
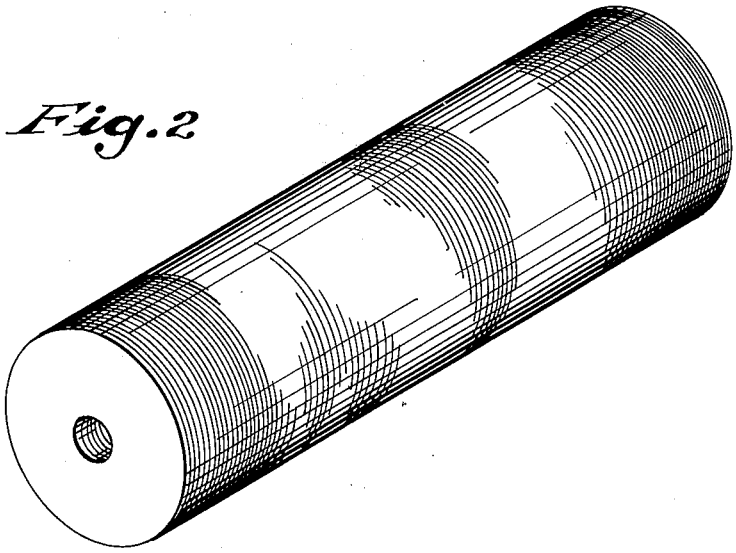
FIG. 2 is a perspective view of a calendar roll to be used in a papermaking machine and fabricated from cellulose material treated in accordance with the invention.

FIG. 2 illustrates the treated cellulose fiber material as used in the fabrication of a calendar roll for a papermaking machine. The calendar roll is laminated from a series of annular stacked sheets of the treated cellulose material, which generally have a thickness in the range of 5 to 20 mils. The annular sheets are assembled on a mandrel and compressed under high pressure. Subsequently, the outer peripheral surface of the laminated roll is machined.

When using the treated cellulose fiber material or paper for a calendar roll, it is desirable to add a flexibilizing or plasticizing agent in the system so as to provide greater flexibility in the final product. Flexibility can be achieved by adding glycerine or polypropylene glycol as a plasticizer in the treating solution in an amount of about 1 to 6% by weight of the resin, or can also be achieved by utilizing a common type of flexibilizing resin or flexibilizing curing agent.

When utilized as a calendar roll, as shown in FIG. 2, the treated cellulosic material is normally subjected to mechanical stress while exposed to a hot air environment which may be in the range of 10°F to 220°F above ambient temperatures. The treated cellulose of the invention is capable of withstanding deterioration when subjected to the conditions of operation of a calendar roll.

The following examples illustrate the method of the invention in treating cellulose fiber material.

EXAMPLE I

A series of samples of 100% Kraft paper (8 inch × 8 inch × 2.5 mils) were immersed in aqueous treating solutions as set forth in the following table until the paper had become thoroughly soaked or impregnated. The impregnated paper sheets were allowed to air dry at room temperature and then each sample sheet was placed in a glass tube containing a 21 inch piece of 16 gauge Formvar-coated copper wire and a 14 inch × 1 inch × 2 mil strip of copper foil. This paper-copper system was dried in an oven at 275°F for sixteen hours, during which time the tube was evacutated under an absolute pressure of about 0.1 mm or less. At the end of the drying period, the evacutated tube conqaining the paper and copper was filled under vacuum with an inhibited transformer oil, leaving an air space in the tube of approximately 15% of the total volume. The air space was filled to 1 atmosphere pressure with dry air and the tube was then sealed off with an oxygen gas torch. The sealed glass tube containing the treated paper, coated copper wire, copper foil and transformer oil was placed in an oven at 340°F for five days after which time both the heated aged samples and the control samples were tested for tensile strength retained. The results of the tests are summarized in the following table:

TABLE I

| | Ingredients of the Treating Solution | Percent of Original Tensile Strength Retained | Relative Tensile Strength |
|---|---|---|---|
| 1 | Control (no treatment) | 14.3 | 100% |
| 2 | 6.5% Epirez 2352 (epoxy resin)<br>2.5% propyldiamide (MW 230) | 76.5 | 485% |
| 3 | 6.5% Epirez 2352 (epoxy resin)<br>0.5% propyldiamide (MW 230)<br>2.0% dicyandiamide | 74.3 | 468% |
| 4 | 2.0% Epirez (epoxy resin)<br>1.07% melamine<br>1.0% soy protein<br>2.0% dicyandiamide | 79.6 | 524% |

The percentage amounts of the ingredients listed in the above table are based on the weight percent of the dry cellulose material based on 100% solids.

The results of the above tests, as shown in the table, indicate the substantial improvement achieved in the tensile strength of the cellulosic material treated in accordance with the invention. The control sample which did not undergo treatment retained only 14.3% of its original tensile strength, while the samples treated in accordance with the composition of the invention retained from 74.3% to 79.6% of their original tensile strength after the heat treating period. The column "Retained Tensile Strength" in the above table indicates the percent improvement in tensile strength as compared with the control sample.

EXAMPLE II

A series of 8 ½ inch × 11 inch × 0.001 inch samples of No. 18 card white calendar paper individually were treated with the treating solutions set forth in the following Table II and using the procedure of Example I. After treatment the samples were subjected to a hot air test to determine the physical characteristics of the treated samples after exposure to the heated air and the results are shown in Table II.

TABLE II

| | Sample Description | Treatment | Tensile Strength lb/½" Width | T.E.A. in-lb/½" Width | Elendorf Tear-Grams | Mullen Burst PSI | Fold Endurance M.I.T Double Folds |
|---|---|---|---|---|---|---|---|
| 1 | Control | none | 6.0 | 1.06 | 29.5 | 21.8 | 27.6 |
| 2 | Control | Aged 24 hrs. at 125°C | 6.1 | 0.90 | 27.0 | 21.9 | 29.5 |
| 3 | 6.5% epoxy resin<br>2.5% polyoxypropylen amine<br>2.0% soy protein<br>0.1% morpholine<br>38.9% water | Aged 24 hrs. at 125°C | 10.5 | 1.82 | 20.4 | 39.3 | 107.0 |
| 4 | 2.2% epoxy resin<br>1.0% melamine<br>1.0% soy protein<br>0.1% morpholine<br>2.0% dicyandiamide<br>93.7% water | Aged 24 hrs. at 125°C | 8.4 | 1.295 | — | 29.8 | 25.4 |
| 5 | 6.5% epoxy resin<br>2.5% dicyandiamide<br>2.0% soy protein<br>0.1% morpholine<br>88.9% water | Aged 24 hrs. at 125°C | 11.4 | — | 19.4 | 38.4 | 196.8 |

The T.E.A. test is a tensile energy absorption test and is a measure of toughness of the paper.

The Elemdorf tear test is a determination of the force in grams required to tear the paper sheet from a formed slit or cut to the edge, while the Mullen burst test is a measurement of the pressure required to burst or rupture the paper sheet.

The fold endurance test is a measure of the number of double folds (180° folds) the paper can be subjected to before fracture and is a determination of brittleness of the paper.

The above ttests show the substantial improvement in tensile strength, tear strength, burst strength, and fold endurance ahieved through use of the process of the invention when the paper was exposed to heated air for extended periods of time.

Various modes of carrying out the invention are contemplated as being within the scope of the following claims particularly pointing out and distinctly claiming the subject matter which is regarded as the invention.

We claim:

1. A method of treating cellulose material to increase its physical properties at elevated temperatures, comprising the steps of impregnating the cellulose material with an aqueous treating medium having dispersed therein a liquid uncured thermosetting resin selected from the group consisting of epoxy resins and polyester resins, and an organic amine, evaporating the water from the aqueous medium, and thereafter curing the resin to provide a treated cellulose material having improved physical properties at elevated temperatures.

2. The method of claim 1, and including the step of incorporating in the aqueous medium a protein material selected from the group consisting of casein, isolated soy protein, collagentype protein, and mixtures thereof.

3. The method of claim 1, wherein the dry cellulose material has a nitrogen content in the range of 0.3% to 10.0% by weight of the cellulose material.

4. The method of claim 1, wherein the resin is present in an amount of 5% to 65% by weight of the cellulose material based on 100% solids.

5. The method of claim 2, and including the step of incorporating in the aqueous medium a water-soluble nitrogen containing solvent for said protein material, said solvent being miscible with water and used in an amount of 0.1 to 5.0% by weight of the cellulose material based on 100% solids.

6. The method of claim 1, and including the step of incorporating in the aqueous medium a water-soluble nitrogen-containing solvent for said resin, said solvent being miscible with water and present in an amount of 0.1% to 5% by weight of the dry cellulose material based on 100% solids.

7. The method of claim 1, wherein said organic amine has a reactive $NH_2$ group and functions as a curing agent for the resin as well as contributing improved heat stability to the treated cellulose material.

8. The method of claim 1, and including the step of incorporating in the aqueous medium a nitrogen-containing compound having a reactive $NH_2$ group, said nitrogen containing compound contributing improved heat stability to the treated cellulose material.

9. A method of treating cellulose material to increase its physical properties at elevated temperatures, comprising the steps of impregnating the cellulose material with an aqueous treating medium having dispersed therein a liquid uncured epoxy resin and an organic amine curing agent for said epoxy resin, said medium containing from 1 to 30% by weight of solids, said resin being present in an amount of 5% to 65% by weight of the cellulose material based on 100% solids, said amine being present in a stoichiometric amount necessary to substantially completely cure said resin, evaporating the water from the aqueous medium, and thereafter curing the resin to provide a treated cellulose material having a nitrogen content in the range of 0.3 to 10% by weight of the dry cellulose material.

10. The method of claim 9, wherein said curing agent is dicyandiamide, and said method includes the step of incorporating in the aqueous-medium a protein material selected from the group consisting of casein, isolated soy protein, collagen-type protein, and mixtures thereof.

11. A treated cellulose fiber product having improved physical properties at elevated temperatures, said product being produced by impregnating a cellulose fiber material with an aqueous treating medium having dispersed therein a liquid uncured thermosetting resin selected from the group consisting of epoxy resins and polyester resins, and an organic amine, evaporating the water from the aqueous medium, and thereafter crosslinking the resin to provide a treated product, containing from 0.3% to 10% by weight of nitrogen based on the weight of the dry cellulose material, said product having sufficient flexibility to be wound in coiled form.

12. The product of claim 11, wherein said product is produced by incorporating in the aqueous medium a protein material selected from the group consisting of casein, isolated soy protein, collagen-type protein, and mixtures thereof.

13. The product of claim 11, wherein the resin is an epoxy resin derived from the reaction of bisphenol-A and epichlorhydrin and the amine is dicyandiamide.

14. The product of claim 11, wherein said product is produced by incorporating in the aqueous medium a nitrogen-containing compound having a reactive $NH_2$ group, said nitrogen containing compound contributing improved heat stability to the treated cellulose material.

15. The product of claim 11, wherein said product is produced by incorporating in the aqueous medium a water-soluble' nitrogen-containing solvent for said resin, said solvent being miscible with water and present in an amount of 0.01% to 5% by weight of the dry cellulose material based on 100% solids.

16. The product of claim 12, wherein said product is produced by incorporating in the aqueous medium a water-soluble nitrogen containing solvent for said protein material, said solvent being miscible with water and used in an amount of 0.1% to 5.0% by weight of the cellulose material based on 100% solids.

17. The product of claim 11, wherein said organic amine has a reactive $NH_2$ group and functions as a curing agent for the resin as well as contributing improved heat stability to the treated cellulose material.

* * * * *

UNITED STATES PATENT AND TRADEMARK OFFICE

CERTIFICATE OF CORRECTION

PATENT NO. : 3,931,027

DATED : January 6, 1976.

INVENTOR(S) : FRED S. SADLER and JOHN LAPP

It is certified that error appears in the above-identified patent and that said Letters Patent are hereby corrected as shown below:

Column 6, Table II, Item 3, Cancel "38.9%" and substitute therefor ---88.9%---

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*